United States Patent [19]

Kure-Jensen et al.

[11] 4,343,454

[45] Aug. 10, 1982

[54] APPARATUS FOR INDIVIDUAL ISOLATION OF HYDRAULICALLY ACTUATED VALVES

[75] Inventors: Jens Kure-Jensen; Patrick S. Coppola, both of Schenectady, N.Y.

[73] Assignee: General Electric Company, Schenectady, N.Y.

[21] Appl. No.: 163,332

[22] Filed: Jun. 26, 1980

[51] Int. Cl.[3] ..... F15B 13/043; F16K 31/124

[52] U.S. Cl. ..... 251/26; 91/450; 251/29

[58] Field of Search ..... 91/450, 451; 251/26, 251/28, 29, 30

[56] References Cited

U.S. PATENT DOCUMENTS

| | | | |
|---|---|---|---|
| 3,182,971 | 5/1965 | Wakeman | 251/26 X |
| 3,495,501 | 2/1970 | Kure-Jensen | 91/440 |
| 3,656,708 | 4/1972 | Hobbs | 251/63.6 |
| 3,684,236 | 8/1972 | Lewis | 251/28 |
| 3,948,478 | 4/1976 | Vind | 251/29 |

OTHER PUBLICATIONS

1977 Electric Utility Engineering Conference, vol. II, Mar. 1977.

*Primary Examiner*—Robert G. Nilson

*Attorney, Agent, or Firm*—Ormand R. Austin; John F. Ahern

[57] ABSTRACT

Apparatus for individually isolating the hydraulic actuators of steam valves for a steam turbine while the turbine remains in operation and while all other steam valves associated with the turbine remain functional. Isolation is achieved by providing a manual isolation valve for blocking the flow of hydraulic fluid from a main supply; a flow restrictor to limit the inflow of hydraulic fluid; and a flow direction control means to limit hydraulic fluid to flow only from the actuator toward an emergency trip hydraulic fluid supply.

12 Claims, 2 Drawing Figures

APPARATUS FOR INDIVIDUAL ISOLATION OF HYDRAULICALLY ACTUATED VALVES

The present invention relates generally to hydraulically actuated steam valves for steam driven turbine-generators, and in particular to apparatus for on-line isolation of hydraulic components of the valve actuator system from the hydraulic supply system.

BACKGROUND OF THE INVENTION

Large steam driven turbine generators of the type used to produce electrical power on a large scale are provided with a number of hydraulically operated valves to control the flow of steam to the turbine. These valves, which may number eight or more for any particular turbine-generator set, include control valves for proportional control of steam flow and shutoff valves for fully opened or fully closed operation.

In the event of a sharp decrease or loss of electrical load, it is essential that the steam supply to the turbine be shut off immediately to prevent damaging overspeed conditions. The length of time permitted between a loss of generator load and the closing of turbine steam valves is on the order of 0.1 to 0.2 seconds. Known examples of hydraulic actuator systems which have been developed and applied for achieving these requirements include the hydraulic operating and emergency closing mechanism taught in U.S. Pat. No. 3,495,501 to Kure-Jensen.

Although such actuator mechanisms have proved to be highly reliable in turbine-generator control, they do require periodic maintenance, repair, and testing to preserve and insure continued reliability. During these procedures in the past, it has been necessary to shut down the entire turbine-generator to service any single actuator. This has resulted from the fact that individual actuators have been without means for separate isolation from the common hydraulic system and shutting down one valve has required that they all be shut down.

Accordingly, it is the principal object of the present invention to provide apparatus for isolating an individual steam valve actuator from the hydraulic supply system so that components of the isolated actuator system can be replaced or repaired without a complete shutdown of the turbine-generator.

Other objects, advantages, and features of the invention will become apparent from the description which follows.

SUMMARY OF THE INVENTION

In a preferred embodiment, the present invention is practiced in combination with a steam valve having a hydraulic actuator system with a disc dump valve which very quickly releases hydraulic pressure on a single-acting piston so that the steam valve is rapidly closed. Apparatus for isolation of the hydraulic actuator includes a manual isolation valve for blocking the main hydraulic fluid pressure supply to the actuator; a flow restriction orifice downstream of the isolation valve which is in line with the disc dump valve so as to limit the inflow of hydraulic fluid to a rate less than that necessary to sustain an open condition of the steam valve during a trip condition; and a check valve in line with the fluid connection to an emergency trip hydraulic supply and connected to permit flow only from the actuator system to the emergency trip supply.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
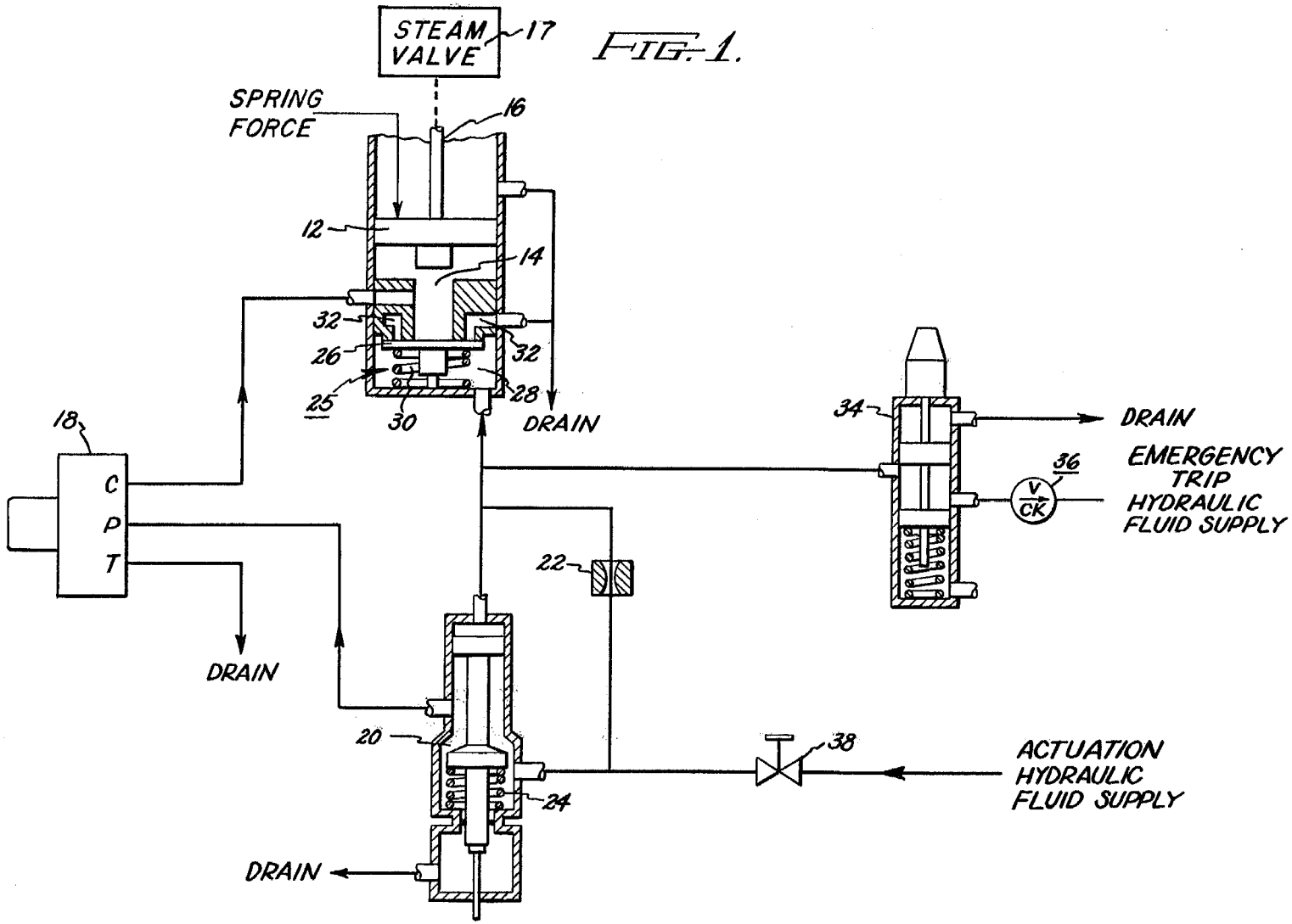
FIG. 1 is an overall schematic illustration of isolation apparatus in a hydraulic actuator system for a steam valve.

In the schematic illustration of the invention in FIG. 1, single-acting piston 12 is urged upward by the pressure of hydraulic fluid supplied to actuator chamber 14. The piston 12 is operatively connected by rod 16 to a steam flow valve 17 to open or close the steam valve 17, or to position it at an intermediate position depending on the pressure in chamber 14. A spring force atop piston 12 works against the hydraulic pressure in chamber 14 to urge the steam valve 17 toward a closed position with a lessening of pressure in chamber 14.

Hydraulic fluid to chamber 14 is supplied through servo valve 18 which is operated to position the steam valve 17 in accordance with its particular mode of operation, i.e., for proportional control or as a shutoff valve. Hydraulic fluid is supplied to the servo valve 18 through shutoff valve 20 from an actuation hydraulic fluid supply. The shutoff valve 20 is opened to permit hydraulic fluid flow to servo valve 18 whenever the pressure of the hydraulic fluid, as applied through orifice 22, is sufficient to overcome the closing force of spring 24. The orifice 22 and its function will be more fully described hereinbelow.

To initiate fast closing of the steam valve 17, a disc dump valve 25 comprising valve disc 26, pilot chamber 28, spring 30, and drain passage 32 is provided to very quickly release the hydraulic pressure in chamber 14 and thus cause closure of the steam valve 17. Pressure in chamber 14 is released either by activating solenoid valve 34 to connect pilot chamber 28 through the solenoid valve 34 to the drain, or by leaving solenoid valve 34 deactivated (as shown) and releasing the pressure applied by the emergency trip hydraulic fluid supply. In the latter case, fluid from pilot chamber 28 flows through solenoid valve 34 and check valve 36 to the emergency trip supply. Operation of the disc dump valve 25 is more fully described in the above cited patent, U.S. Pat. No. 3,495,501, the disclosure of which is incorporated herein by reference thereto.

To isolate hydraulic components of the actuator system from the hydraulic fluid supplies to permit maintenance or repair to those components, an isolation subsystem is provided comprising manual isolation valve 38, orifice 22, and check valve 36. Components of the actuator system thereby isolated comprise a hydraulic control subsystem including servo valve 18, shutoff valve 20, solenoid valve 34, and disc dump valve 25 having fluid chambers 14 and 28.

The isolation apparatus operates as follows. Manual isolation valve 38 is first closed to block the application of hydraulic fluid pressure from the actuation hydraulic fluid supply to the pilot chamber 28 of the disc dump valve 25 and to the shutoff valve 20. Pressure in pilot chamber 28 may then be released rapidly by activating solenoid valve 34 or, if desired or necessary, the pressure may be allowed to slowly bleed off without activating solenoid valve 34. In either case, the disc dump valve opens and allows the spring force applied to piston 12 to close the steam valve 17. Check valve 36, with reduced pressure on the side thereof connected through solenoid valve 34 to the pilot chamber 28, is held firmly closed by the hydraulic pressure applied to the other side by the emergency trip supply. With both hydraulic fluid supplies thus isolated, hydraulic components of the actuator can be repaired or removed as necessary without shutting down the entire hydraulic system and the other steam valves operated thereby. The important feature is that the turbine-generator may continue to operate as each individual valve receives attention.

Orifice 22 is an element of the invention principally utilized during a trip operation in which the steam valve 17 must be rapidly closed. With manual isolation valve 38 open (a non-isolated condition), a trip occurs by rapid release of hydraulic fluid from pilot chamber 28. Under this condition, orifice 22 restricts the inflow of fluid from the actuation supply to an amount less than is required to keep the disc dump valve closed. In other words, orifice 22 limits the inflow of hydraulic fluid to a rate significantly less than the outflow rate of fluid from pilot chamber 28. This permits the disc dump valve to operate as desired on a trip condition, e.g., turbine overspeed.

Preferably, orifice 22 is a sharp edge orifice chosen to be sufficiently large to prevent clogging by entrained impurities in the hydraulic fluid but limited in size so as to perform its function of restricting the inflow of fluid. Sharp-edged orifice sizes from about 0.015 inches in diameter to about 0.062 inches, for example, provide satisfactory performance in the embodiment of FIG. 1. Other flow restrictors of equivalent effective diameter provide similar results.

With manual valve 38 closed it can be seen that depressurization of the emergency trip supply pressure will also cause depressurization of chamber 28 and hence a rapid closure of the valve actuator.

Figure 2:
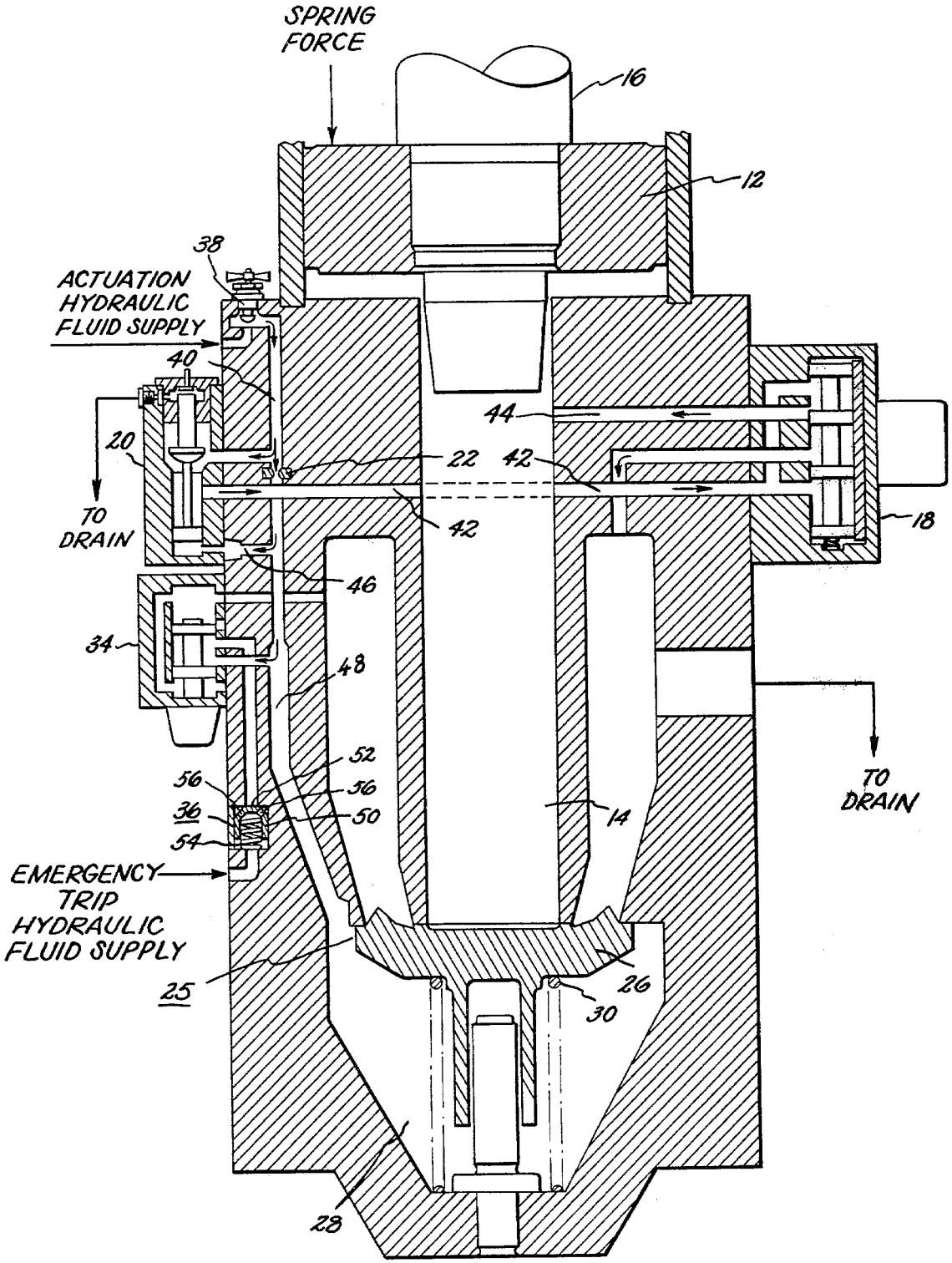
FIG. 2 is a sectional view of a steam valve actuator system incorporating the invention and according to the schematic of FIG. 1.

FIG. 2, which is not to scale, illustrates an embodiment of the hydraulic flow scheme of FIG. 1 in a hydraulic actuator system. Identical reference numerals in FIGS. 1 and 2 denote identical elements common to the two Figures.

Referring now to FIG. 2, actuation fluid is supplied to the actuator system through manual isolation valve 38 which is open under normal operating conditions. Fluid pressure and flow are then applied by passage 40 to shutoff valve 20 and orifice 22. With the shutoff valve 20 open as shown, fluid is free to pass to servo valve 18 by passage 42 and thence through passage 44 to actuator chamber 14, where, depending on the pressure allowed to be applied by the servo valve 18, piston 12 is displaced to operate the connected steam valve.

Fluid flow from the orifice 22 is applied via passage 46 to maintain valve 20 in an open position and via passage 48 to pilot chamber 28 wherein fluid pressure exerted against disc 26 maintains the disc pump valve 25 normally closed. Fluid flow and pressure from orifice 22 and passage 48 are also applied to fast acting solenoid valve 34, and, with the solenoid valve 34 deactivated as shown, to the forward flow direction of check valve 36. Check valve 36 provides means for directional flow control, limiting hydraulic fluid flow so that it can only flow toward the emergency trip supply. However, evacuation of the emergency trip line, such as occurs with a turbine trip, allows propagation of the low pressure through the check valve 36, releases the disc 26 of the disc dump valve 25 and causes closure of the steam valve by quick release of hydraulic pressure in chamber 14.

The check valve 36 is a poppet type device in which poppet 50 is normally forced against valve seat 52 by spring 54. Lower pressure at the emergency trip supply side of the check valve 36 than at the opposite side causes the poppet 50 to be displaced from seal 52 and permits fluid flow through small openings, such as holes 56, in poppet 50.

As discussed in connection with FIG. 1, isolation of the actuator system is achieved by simply closing manual isolation valve 38. This implements a closing of the steam valve, and since hydraulic actuation fluid is no longer available to the actuator system, check valve 36 will be closed automatically by the emergency trip supply pressure. With valves 36 and 38 mounted in a common hydraulic manifold and mechanically independent of other components, it can be seen that these other components have become isolated from the two hydraulic supply pressures. Reactivation of the actuator is achieved by gradual opening of isolation valve 38.

The foregoing has shown and described a preferred embodiment of the invention. It will be recognized and understood, however, that various modifications may be made to the invention without deviation from the scope of the invention. For example, the manual isolation valve may be replaced with an automatically operated valve and the check valve may be replaced with other directional flow control means. It is intended by the appended claims to claim all such modifications and embodiments which fall within the true spirit and scope of the present invention.

What is claimed is:

1. In combination with a steam valve for a steam turbine, said valve having a hydraulic actuator including a pilot chamber for control of a disc dump valve for fast valve closure and operable from an actuation hydraulic fluid supply and from an emergency trip hydraulic fluid supply, apparatus for hydraulically isolating said actuator, comprising:

valve means for shutting off hydraulic flow from said actuation supply to said actuator;

flow restriction means fluidly interposed directly between said emergency trip supply and said pilot chamber for limiting the inflow rate of hydraulic fluid to said pilot chamber; and flow direction control means fluidly interposed between said emergency trip supply and said pilot chamber, said flow direction control means permitting hydraulic fluid flow only toward said emergency trip supply;

said valve means and said flow direction control means being operative to isolate said actuator from said actuation supply and said emergency trip supply upon closure of said valve means.

2. The combination of claim 1 wherein said valve means is a manually operated valve.

3. The combination of claims 1 or 2 wherein said flow direction control means is a check valve.

4. The combination of claims 1 or 2 wherein said flow restriction means is a sharp-edge orifice.

5. The combination of claim 3 wherein said flow restriction means is a sharp-edged orifice.

6. The combination of claim 4 wherein said orifice has an effective diameter of from about 0.015 inches to about 0.062 inches.

7. The combination of claim 5 wherein said orifice has an effective diameter of from about 0.015 inches to about 0.062 inches.

8. A hydraulic actuator system for a steam valve which can be isolated from an actuation hydraulic fluid supply and from an emergency trip hydraulic fluid supply common to other hydraulic actuator systems while hydraulic pressure is maintained by each hydraulic fluid supply, said actuator system comprising:

a hydraulic control subsystem including an actuator chamber for receiving hydraulic fluid from said actuation supply, means responsive to hydraulic fluid pressure in said actuation chamber to operate said steam valve, a servo valve for controlling hydraulic pressure in said actuator chamber, a disc dump valve having a pilot chamber for rapid closure of said steam valve upon release of hydraulic pressure from said pilot chamber, a solenoid valve responsive to an external command to release hydraulic pressure from said pilot chamber, and a shutoff valve for blocking hydraulic fluid flow to said servo valve upon release of hydraulic pressure from said pilot chamber; and an isolation subsystem including an isolation valve for shutting off hydraulic fluid flow from said actuation supply to said hydraulic control subsystem, a hydraulic fluid flow restrictor interposed between said isolation valve and said pilot chamber, and check valve means interposed between said emergency trip supply and said pilot chamber for restricting hydraulic fluid to flow only toward said emergency trip supply, said isolation subsystem operative to isolate said hydraulic control subsystem from said actuation supply and from said emergency trip supply upon closure of said isolation valve.

9. The hydraulic actuator system of claim 8 wherein said hydraulic fluid flow restrictor is a sharp-edged orifice.

10. The hydraulic actuator system of claim 9 wherein said orifice has an effective diameter of from 0.015 inches to 0.062 inches.

11. The hydraulic actuator system of claim 8 wherein said isolation valve is a manually operated valve.

12. The hydraulic actuator system of claim 11 wherein said check valve means is a poppet type check valve.

* * * * *